US006872774B2

(12) United States Patent
Sullivan et al.

(10) Patent No.: US 6,872,774 B2
(45) Date of Patent: Mar. 29, 2005

(54) GOLF BALL WITH NON-IONOMERIC LAYER

(75) Inventors: Michael J. Sullivan, Barrington, RI (US); Michael D. Jordan, East Greenwich, RI (US); Derek A. Ladd, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 86 days.

(21) Appl. No.: 10/320,144

(22) Filed: Dec. 16, 2002

(65) Prior Publication Data

US 2003/0125480 A1 Jul. 3, 2003

Related U.S. Application Data

(63) Continuation-in-part of application No. 10/077,081, filed on Feb. 15, 2002, which is a continuation-in-part of application No. 09/992,448, filed on Nov. 16, 2001, now abandoned.

(51) Int. Cl.[7] ..... A63B 37/00

(52) U.S. Cl. ..... 525/57; 525/78; 525/130; 525/176; 525/183; 525/221; 473/374

(58) Field of Search ..... 525/57, 78, 130, 525/176, 183, 221; 473/374

(56) References Cited

U.S. PATENT DOCUMENTS

| | | | | |
|---|---|---|---|---|
| 5,397,840 A | | 3/1995 | Sullivan et al. | 525/221 |
| 5,516,847 A | | 5/1996 | Sullivan et al. | 525/221 |
| 5,713,802 A | | 2/1998 | Moriyama et al. | 473/374 |
| 5,728,502 A | * | 3/1998 | Ou-Yang et al. | 430/126 |
| 5,779,561 A | | 7/1998 | Sullivan et al. | 473/373 |
| 5,830,087 A | | 11/1998 | Sullivan et al. | 473/385 |
| 5,981,654 A | | 11/1999 | Rajagopalan | 525/66 |
| 6,001,930 A | | 12/1999 | Rajagopalan | 525/92 B |
| 6,124,389 A | | 9/2000 | Cavallaro et al. | 524/432 |
| 6,232,400 B1 | * | 5/2001 | Harris et al. | 525/176 |
| 6,306,968 B1 | * | 10/2001 | Bellinger et al. | 525/179 |
| 6,334,819 B2 | * | 1/2002 | Ichikawa et al. | 473/371 |
| 2004/0059062 A1 | * | 3/2004 | Kim | 525/222 |

OTHER PUBLICATIONS

US 2002/0173382, Nov. 2002, Sullivan, U.S. patent application Ser. No. 09/815,753, filed Mar. 23, 2001.

US 2002/0169037, Nov. 2002, Sullivan, U.S. patent application Ser. No. 10/082,577, filed Feb. 25, 2002.

US 2002/0151381, Oct. 2002, Sullivan, U.S. patent application Ser. No. 10/160,827, filed May 30, 2002.

US 2001/0044496, Nov. 2001, Bellinger et al., U.S. patent application Ser. No. 09/241,186, filed Feb. 1, 1999.

* cited by examiner

*Primary Examiner*—David J. Buttner
(74) *Attorney, Agent, or Firm*—William B. Lacy

(57) ABSTRACT

The present invention is directed to a multi-layer golf ball having a core, an intermediate layer and a cover. The intermediate layer has a non-ionomeric composition that includes an ethylene/acid polymer and a non-ionomeric stiffening polymer. The stiffening polymer provides the non-ionomeric composition with a flexural modulus and a hardness that are greater than those of the ethylene/acid polymer.

29 Claims, No Drawings

GOLF BALL WITH NON-IONOMERIC LAYER

CROSS-REFERENCE TO RELATED APPLICATIONS

This application is a continuation-in-part of co-pending U.S. patent application Ser. No. 10/077,081, filed on Feb. 15, 2002, which is a continuation-in-part of U.S. patent application Ser. No. 09/992,448, filed on Nov. 16, 2001, now abandoned. The entire disclosures of these applications are incorporated by reference herein.

FIELD OF THE INVENTION

The present invention relates to golf balls, and more particularly to a novel golf ball composition with an enhanced flexural modulus, an enhanced material hardness and a reduced water vapor transmission rate.

BACKGROUND OF THE INVENTION

Solid core golf balls are well known in the art. Typically, solid cores comprise a crosslinked polybutadiene rubber material, which provides the primary source of resiliency for the golf ball. Further increase in core resiliency can be achieved by increasing the cross-link density of the polybutadiene. The core is typically protected by a cover, and may comprise additional layers in between, such as outer core layers, intermediate layers, or inner cover layers. One or more of these additional layers may be a wound layer of tensioned elastic windings.

A known drawback of polybutadiene cores cross-linked with zinc diacrylate is that zinc diacrylate is adversely affected by moisture. Water moisture vapor reduces the resiliency of the cores and degrades its properties. A polybutadiene core will absorb water and loose its resilience. It is beneficial to apply a cover layer over the core shortly after core molding to maintain optimum ball properties. The cover is typically made from ionomer resins, balata, or urethane, among other materials. Ionomer covers, particularly harder ionomers, offer some protection against the penetration of water vapor. However, it is more difficult to impart spin to balls with hard covers. Conventional urethane covers, on the other hand, while providing better ball control, offer less resistance to water vapor than ionomer covers.

Several prior patents have addressed the water vapor absorption problem. U.S. Pat. No. 5,820,488 discloses a golf ball with a solid inner core, an outer core layer, and a water vapor barrier layer disposed therebetween. The water vapor barrier layer preferably has a water vapor transmission rate ("WVTR") lower than that of the cover layer. The water vapor barrier layer can be a polyvinylidene chloride ("PVDC") layer. It can also be formed by an in situ reaction between a barrier-forming material and the outer surface of the core. Alternatively, the water vapor barrier layer can be a vermiculite layer. U.S. Pat. Nos. 5,885,172 and 6,132,324 disclose, among other things, a golf ball with a polybutadiene or wound core with an ionomer resin inner cover and a relatively soft outer cover. The hard ionomer inner cover offers some resistance to water vapor penetration and the soft outer cover provides the desirable ball control.

There is still a need, however, for an efficient and effective composition that can replace the conventional ionomer-based composition for a golf ball layer. The present invention is direct to such a composition that can provide a non-ionomeric layer having improved flexural modulus, material hardness, and water vapor barrier property.

SUMMARY OF THE INVENTION

The present invention is directed to a multi-layer golf ball having a core, an intermediate layer and a cover. The intermediate layer has a non-ionomeric composition of a non-ionomeric stiffening polymer and at least one E/Y copolymer or E/X/Y terpolymer, wherein E is an olefin, Y is a carboxylic acid, and X is a softening comonomer. The stiffening polymer provides the non-ionomenic composition with a flexural modulus and material hardness substantially greater than the copolymer or terpolymer.

Preferably, the olefin is ethylene; the carboxylic acid is acrylic acid, methacrylic acid, crotonic acid, maleic acid, fumaric acid, itaconic acid, or a combination thereof, and the softening comonomer is vinyl esters of aliphatic carboxylic acids of 2 to about 10 carbon atoms, alkyl ethers of 1 to about 10 carbon atoms, alkyl acrylates or alkyl alkylacrylates of 1 to about 10 carbon atoms, or blends thereof. Preferred E/Y copolymers are ethylene/acrylic acid copolymers or ethylene/methacrylic acid copolymers, and preferred E/X/Y terpolymers are ethylene/methyl acrylate/acrylic acid terpolymers, ethylene/n-butyl acrylate/methacrylic acid terpolymers, or ethylene/isobutyl-acrylate/methacrylic acid terpolymers.

The copolymer or terpolymer preferably has an acid content of from about 1% to about 30% by weight, a melt flow rate of from about 1 g/10-min to about 500 g/10-min, a WVTR of from about 0.01 to about 0.9 g·mm/m$^2$/day at 38° C. and 90% relative humidity, a flexural modulus of from about 5,000 psi to about 55,000 psi, and a material hardness of from about 20 Shore D to about 65 Shore D. The non-ionomenic composition preferably has a flexural modulus of at least about 30,000 psi, and a material hardness of at least about 55 Shore D. The copolymer or terpolymer may be present in an amount of from about 5% to about 95% by weight of the non-ionomeric composition.

The stiffening polymer may be homopolymeric or copolymeric, and comprises polyamides, single-site catalyzed polymers, metallocene-catalyzed polymers, polyesters, poly(ethylene terephthalate), poly(butylene terephthalate), poly(propylene terephthalate), poly (trimethylene terephthalate), poly(ethylene naphthenate), polystyrene polymers, poly(styrene-co-maleic anhydride), acrylonitrile-butadiene-styrene, poly(styrene sulfonate), polyethylene styrene, grafted polypropylenes, grafted polyethylenes, polyvinyl chlorides; grafted polyvinyl chlorides; polyvinyl acetates having less than about 9% of vinyl acetate by weight, polycarbonates, blends of polycarbonate and acrylonitrile-butadiene-styrene, blends of polycarbonate and polyurethane, polyvinyl alcohols, polyvinyl alcohol copolymers, polyethers, polyarylene ethers, polyphenylene oxides; block copolymers of alkenyl aromatics with vinyl aromatics and poly(amic ester)s, polyimides, polyetherketones, polyamideimides, or blends thereof. Preferably, the stiffening polymer is compatibilized with at least one grafted or copolymerized functional group such as maleic anhydride, amine, epoxy, isocyanate, hydroxyl, carbonate, sulfonate, phosphonate, or a combination thereof. The stiffening polymer may be present in an amount of from about 95% to about 5% by weight of the non-ionomeric composition.

The intermediate layer may have a thickness of from about 0.005 inches to about 0.1 inches. The core may have a diameter of at least about 1.3 inches, a compression of less than about 80, and a coefficient of restitution of at least about 0.75. The core construction may include a center and at least one outer core layer. The center can be solid, liquid-filled, gel-filled, or gas-filled, while the at least one outer core layer can be a solid continuous layer, a discontinuous layer, a wound layer, an adhesive layer, or a lattice network layer. The cover construction may include an outer cover layer, and optionally one or more inner cover layer. The outer cover layer preferably has a thickness of less than about 0.05 inches and an on-ball hardness of less than about 60 Shore D.

The present invention is also directed to a golf ball having a core, a cover, and a intermediate layer formed from a non-ionomeric composition having a blend of a first and second non-ionomeric acid polymers and a non-ionomeric stiffening polymer. The first and second non-ionomeric acid polymers are E/Y copolymers or E/X/Y terpolymers, wherein E is an olefin, Y is a carboxylic acid, and X is a softening comonomer. The stiffening polymer provides the non-ionomeric composition with a flexural modulus and material hardness substantially greater than the non-ionomeric acid polymer blend.

The first and second non-ionomeric acid polymers have a weight ratio of from about 5:95 to about 95:5. Preferably, the non-ionomeric composition has a flexural modulus of from about 40,000 psi to about 150,000 psi, and a material hardness of from about 60 Shore D to about 90 Shore D. Also preferably, the first non-ionomeric acid polymer is an ethylene/acrylic acid copolymer or an ethylene/methacrylic acid copolymer, while the second non-ionomeric acid polymer is an ethylene/methyl acrylate/acrylic acid terpolymer, an ethylene/n-butyl acrylate/methacrylic acid terpolymer, or an ethylene/isobutyl acrylate/methacrylic acid terpolymer. The non-ionomeric acid polymer blend may be present in an amount of from about 5% to about 95% by weight of the non-ionomenic composition. The non-ionomeric composition preferably has a melt flow rate of at least about 1 g/10-min and a water vapor transmission rate of less than the cover. The intermediate layer preferably has a thickness of from about 0.01 inches to about 0.05 inches.

Definitions

As used herein, the term "flexural modulus" or "modulus" refers to the ratio of stress to strain within the elastic limit (when measured in the flexural mode) of a material and is similar to its tensile modulus. This property is used to indicate the bending stiffness of the material. Flexural modulus, typically reported in Pascal ("Pa") or pounds per square inches ("psi"), is derived in accordance to ASTM D6272-02 titled "Standard Test Method for Flexural Properties of Unreinforced and Reinforced Plastics and Electrical Insulating Materials by Four-Point Bending."

As used herein, the term "melt flow rate" ("MFR"), also known as "melt flow index," "melt flow," "melt mass-flow rate," or simply as "flow rate," refers to the rate of extrusion of thermoplastics through an orifice at a prescribed temperature and load. Typically, an extrusion plastometer or rheometer is used, wherein a certain amount of the material is loaded into a barrel of the melt flow apparatus, heated to a temperature specified for the material, and forced through a standardized die of a specified length and diameter by a piston under a specified weight load for the material. A timed extrudate is collected and weighed, and the MFR of the material is calculated in g/10 min. Standard tests for MFR include ASTM D1238-01e1 titled "Standard Test Method for Melt Flow Rates of Thermoplastics by Extrusion Plastometer." The benefits of high MFR include easy extrusion, high extrusion rate, high flow during heat sealing, and the ability to make thin films of moisture vapor barrier layer. Without limiting the present invention to any particular theory, materials with relatively high MFR have relatively low viscosity. Low viscosity helps the materials spread evenly and thinly to produce a thin film.

As used herein, the term "water vapor transmission rate" ("WVTR") refers to the mass of water vapor that diffuses into a material of a given thickness per unit area per unit time at a specified temperature and humidity differential. Standard methods to measure WVTR include ASTM D6701-01 titled "Standard Test Method for Determining Water Vapor Transmission Rates Through Nonwoven and Plastic Barriers."

As used herein, the term "material hardness" refers to indentation hardness of non-metallic materials in the form of a flat slab or button as measured with a durometer. The non-metallic materials include thermoplastic elastomers, vulcanized (thermoset) rubber, elastomeric materials, cellular materials, gel-like materials, and other rubbers or plastics. The durometer has a spring-loaded indentor that applies an indentation load to the slab, thus sensing its hardness. The material hardness can indirectly reflect upon other material properties, such as tensile modulus, resilience, plasticity, compression resistance, and elasticity. Standard method to measure the material hardness include ASTM D2240-02a titled "Standard Test Method for Rubber Property-Durometer Hardness. Material hardness reported herein is in Shore D units.

As used herein, the term "on-ball hardness" refers to the hardness of a portion of a golf ball measured directly on the golf ball (or other spherical surface), and is completely different from the material hardness in nature and in value. The difference in value stems primarily from the components of the golf ball that underlie the portion being measured (i.e., center, core and/or layers), including their construction, size, thickness, and material composition. Therefore, it is understood to one of ordinary skill in the art that the on-ball hardness and the material hardness are not correlated or convertible.

As used therein, the term "compression," also known as "ATTI compression" or "PGA compression," refers to points derived from a Compression Tester (ATTI Engineering Company, Union City, N.J.), a scale well known in the art for determining relative compression of a subject. The Compression Tester is equipped with a Federal Dial Gauge (Model D81-C), and applies a spring-loaded force against the subject, such as a golf ball center, a golf ball core, a core with additional layers, or a whole golf ball. A spring compress of 0.2 inches indicates a compression of 100 for the subject, while a spring compress of 0.1 inches indicates a compression of 0 for the subject. Compression is a property of a material as measured on a golf ball construction (i.e., on-ball property), not a property of the material per se.

As used herein, the term "coefficient of restitution" or "COR" for golf balls is defined as the ratio of a ball's rebound velocity to its initial incoming velocity when the ball is fired out of an air cannon into a rigid vertical plate. The faster a golf ball rebounds, the higher the COR it has, and usually the longer the distance it yields in play. The range of the initial velocity is from about 50 ft/s to about 200 ft/s, and is usually understood to be 125 ft/s, unless otherwise specified. A golf ball may have different COR values at different initial velocities.

The term "about," as used herein in connection with one or more numbers or numerical ranges, should be understood to refer to all such numbers, including all numbers in a range.

DETAILED DESCRIPTION OF THE INVENTION

Golf balls of the present invention may have a variety of multi-layer constructions, comprising at least a core, a cover, and an intermediate layer disposed between the core and the cover. The core may be a single solid mass, or include a center and one or more outer core layers. The center may further be solid, liquid-filled, gel-filled, or gas-filled. The cover may include one or more inner cover layers and an outer cover layer. Any of the outer core layers, the intermediate layers or the inner cover layers may be a wound layer, a molded layer, an adhesive or coupling layer, a continuous or discontinuous layer, a lattice network, a web or net, a layer with uniformed or non-uniformed thickness, a layer having a plurality of discrete elements such as islands and protrusions, a metallic layer, or a foamed layer.

The solid core can be made from any suitable core materials including thermoset polymers, such as natural rubber, polybutadiene, polyisoprene, styrene-butadiene or styrene-propylene-diene rubber, and thermoplastics such as ionomer resins, polyamides, polyesters, or a thermoplastic elastomer. Suitable thermoplastic elastomers include Pebax® from AtoFina Chemicals Inc., Hytrel® from E.I. Du Pont de Nemours and Company, thermoplastic urethane from various manufacturers, and Kraton® from Shell Chemical Company. The core materials can also be formed from a castable material. Suitable castable materials include those comprising a urethane, polyurea, epoxy, silicone, etc. Additionally, suitable core materials may also include a reaction injection molded ("RIM") polyurethanes or polyurea. Preferred RIM polyurethanes are nucleated versions, where a gas like nitrogen is whipped into the prepolymer prior to injection into a closed mold to form the polyurethane layer.

Preferred compositions for solid cores include a base rubber, a crosslinking agent, and an initiator. The base rubber typically includes natural or synthetic rubbers. A preferred base rubber is 1,4-polybutadiene having a cis-bond of at least about 90%, a Mooney viscosity of at least about 30, a molecular weight of at least about 100,000, and a polydispersity of less than about 4. The measurement of Mooney viscosity is defined according to ASTM D1646-00 titled "Standard Test Methods for Rubber-Viscosity, Stress Relaxation, and Pre-Vulcanization Characteristics (Mooney Viscometer)." Examples of desirable polybutadiene rubbers include Buna® CB22 and CB23 from Bayer, Ubepol® 360L and 150L from Ube Industries, and Cariflex® BCP820 and BCP824 from Shell Chemical. Blends of two or more such polybutadienes having a Mooney viscosity of from about 40 to about 150 are desirable for the solid cores. The polybutadiene can also be mixed with other elastomers known in the art such as natural rubber, polyisoprene rubber and/or styrene-butadiene rubber in order to modify the properties of the core.

Suitable cross-linking agents for the polybutadiene-based solid cores include metal salts of unsaturated fatty acid having 3 to 8 carbon atoms, such as diacrylate, dimethacrylate, and monomethacrylate, wherein the metal can be magnesium, calcium, zinc, aluminum, sodium, lithium or nickel. Preferred acrylates include zinc acrylate, zinc diacrylate ("ZDA"), zinc methacrylate, zinc dimethacrylate, and blends thereof. Zinc diacrylate is preferred because it provides golf balls with a high initial velocity, but the present invention is not limited thereto. The crosslinking agent is typically present in an amount of at least about 10 parts per hundred ("pph") parts of the base polymer, preferably from about 20 to 40 pph of the base polymer.

The polymerization initiators to promote the cross-linking reaction in the core are well known in the art, and can be any known free radical initiators or blends thereof that decompose during the cure cycle. Suitable free radical initiators include organic peroxide compounds, such as dicumyl peroxide; 1,1-di(t-butylperoxy)3,3,5-trimethyl cyclohexane; α,α-bis(t-butylperoxy)diisopropylbenzene; 2,5-dimethyl-2,5 di(t-butylperoxy)hexane; di-t-butyl peroxide; and blends thereof. Other examples include, but are not limited to, Varox® 231XL and DCP-R from AtoFina, Perkadox® BC and 14 from Akzo Nobel, and Elastochem® DCP-70 from Rhein Chemie. In their pure forms, the initiators are present in an amount of at least about 0.25 pph of the base polymer, preferably between about 0.5 pph and about 2.5 pph. It is understood to one skilled in the art to adjust the amount of the initiators according to their activity and concentration.

In polybutadiene-based solid cores of the present invention, it is preferred to blend in a halogenated organosulfur compound such as a halogenated thiophenol or a metal salt thereof to further enhance the softness and resiliency of the core. The halogenated thiophenol, preferably pentachlorothiophenol ("PCTP") or ZnPCTP, function in part as a cis-to-trans catalyst that convert cis-1,4 bonds in the polybutadiene to trans-1,4 bonds. The utilization of halogenated organosulfur compounds like PCTP and ZnPCTP in golf balls to produce soft and fast cores is disclosed in co-pending U.S. patent application Ser. No. 09/951,963, which is incorporated by reference herein in its entirety. PCTP is available under the tradename Struktol® from Struktol Company of America, and ZnPCTP is available from eChinaChem. The halogenated organosulfur compounds are present in an amount of at least about 2 pph, more preferably between about 2.3 pph and about 5 pph.

The solid core may also include fillers to adjust hardness, strength, modulus, weight, density and/or specific gravity of the core. Suitable fillers include metal or alloy powders, metal oxides and salts, ceramics, particulate, carbonaceous materials, polymeric materials, glass microspheres, and the like or blends thereof. These fillers may be solid or hollow. Specific fillers for the core include tungsten powder, tungsten carbide, zinc oxide, tin oxide, tungsten oxide, barium sulfate, zinc sulfate, barium carbonate, calcium carbonate, zinc carbonate, an array of silica and clay, regrind (recycled core material typically ground to about 30 mesh particle).

Other optional additive for the golf ball core are well known in the art, and may be blended into the core in amounts sufficient to achieve their specific purposes and desired effects. Such additives include antioxidants to prevent premature crosslinking or any molecular breakdown of the rubber compound, accelerators to speed up the polymerization reaction, processing aids oils to affect rheological and mixing properties, foaming agents, cis-to-trans catalysts, adhesives, coupling agents, stable free radicals, radical scavengers, scorch retarders, and blends thereof.

The sold core of the golf ball of the present invention preferably has a diameter of at least about 1.3 inches, more preferably at least about 1.5 inches, and most preferably at least about 1.55 inches. Alternatively, the core diameter may be less than about 1.3 inches, or less than about 1 inch. In one embodiment, the solid core has a diameter of about 1.59 inches. The core may have a compression of from about 20 to about 120, more preferably from about 30 to about 110, and most preferably from about 40 to about 100. Alternatively, the core can be very soft, with a compression of less than about 20. In one embodiment, the solid core has a compression of preferably less than about 80, more preferably less than about 70. The core should also be highly resilient, having a COR of preferably greater than about 0.7, more preferably greater than about 0.75, and most preferably greater than about 0.8. In one embodiment, the core has a center and two or more outer core layers. Conventional methods and techniques may be used to form the solid cores from the base compositions disclosed herein.

As mentioned before, the at least one intermediate layer is disposed between the core and the cover, and can be an outer core layer or an inner cover layer. To prevent or minimize the penetration of moisture, typically water vapor, into the solid core, the intermediate layer preferably has a WVTR that is lower than that of the cover. More preferably, the WVTR of the intermediate layer is less than that of an ionomer resin such as Surlyn®, which is in the range of about 0.45 to about 0.95 g/m$^2$/day.

In a preferred embodiment of the present invention, the intermediate layer has a non-ionomeric composition that comprises a non-ionomeric acid polymer and a compatible non-ionomeric stiffening polymer, so that the composition is greater than the non-ionomeric acid polymer in flexural modulus and material hardness. The non-ionomeric acid polymer can be an E/Y copolymer or an E/X/Y terpolymer. E is an olefin such as ethylene. Y is a carboxylic acid such as acrylic, methacrylic, crotonic, maleic, fumaric, itaconic acid, or combinations thereof. X is a softening comonomer, such as vinyl esters of aliphatic carboxylic acids wherein the acid has 2 to about 10 carbon atoms, alkyl ethers wherein the alkyl group has 1 to about 10 carbon atoms, alkyl acrylates wherein the alkyl group has 1 to about 10 carbon atoms, or alkyl alkylacrylates such as alkyl methacrylates wherein the alkyl group has 1 to about 10 carbon atoms. Suitable softening comonomers X include vinyl acetate, methyl acrylate, methyl methacrylate, ethyl acrylate, ethyl methacrylate, iso-butyl acrylate, n-butyl acrylate, butyl methacrylate, or the like. Specific examples of the non-ionomeric acid copolymer include ethylene/acrylic acid copolymers ("EAA") and ethylene/methacrylic acid copolymers ("EMAA"). Examples of the non-ionomeric acid terpolymer are ethylene/methyl acrylate/acrylic acid terpolymers ("EMAAA"), ethylene/n-butyl acrylate/methacrylic acid terpolymers, and ethylene/isobutyl acrylate/methacrylic acid terpolymers. Commercially, EAA resins are available from Dow Chemical under the trade name of Primacor® and from ExxonMobil Chemical under the trade name of Escor®, EMAA resins are available from E.I. du Pont de Nemours and Company under the trade name of Nucrel®, and EMAAA resins are available from ExxonMobil Chemical under the trade name of Escor® AT.

Preferably, the acid content within the non-ionomeric acid copolymers or terpolymers ranges from about 1% to about 30% by weight, more preferably from about 3% to about 25%, and most preferably from about 5% to about 20%. Such non-ionomeric acid copolymers and terpolymers typically have high MFR, preferably ranging from about 1 g/10-min to about 500 g/10-min, more preferably from about 3 g/10-min to about 75 g/10-min, and most preferably from about 3 g/10 min to about 50 g/10 min. For example, EMAA resins such as Nucrel® 599 and 2940, both available from DuPont, have a respective acid content of 10% and 19% by weight, and a respective MFR of 500 g/10-min and 395 g/10-min. In comparison to Surlyn®D ionomers (MFR about 1–14 g/10-min), EMAA resins clearly have superior flow characteristic under heat.

Properties of the preferred non-ionomeric acid copolymers and terpolymers are summarized in Table 1 below. In particular, the suitable non-ionomeric acid copolymers and terpolymers have a flexural modulus of preferably from about 5,000 psi to about 55,000 psi, more preferably from about 10,000 psi to about 30,000 psi. The non-ionomeric acid copolymers and terpolymers also has a material hardness of preferably from about 20 Shore D to about 65 Shore D, more preferably from about 40 Shore D to about 65 Shore D. The non-ionomeric acid copolymers and terpolymers further have a WVTR of from about 0.01 to about 0.9 g/m$^2$/day at 38° C. and 90% relative humidity. Other choices for the non-ionomenrc acid copolymers and terpolymers are known to one of ordinary skill in the art, and include those disclosed in U.S. Pat. Nos. 6,124,389; 5,981,654; 5,516,847; and 5,397,840, all of which are incorporated by reference in their entirety.

TABLE 1

| Property | Range | ASTM |
|---|---|---|
| % Weight of Acid | 1%–30% | Manufacturer |
| MFR (g/10-min) | 1–500 | D1238-O1e1 |
| Specific Gravity (g/cm$^3$) | 0.92–0.96 | D792-00 |
| Flexural Modulus (psi) | 5,000–25,000 | D6272-02 |
| Hardness (Shore D) | 20–65 | D2240-02a |
| WVTR (g · mm/m$^2$/day) | 0.01–0.9 | D6701-01 |

The compatible non-ionomeric stiffening polymer is blended with the above-described non-ionomeric acid copolymers or terpolymers to boost the flexural modulus and material hardness of the non-ionomeric composition of the intermediate. The flexural modulus and material hardness of the non-ionomeric stiffening polymer should be substantially greater than those of the non-ionomeric composition, which are in turn substantially greater than those of the non-ionomeric acid polymer. Preferably, the intermediate layer comprises from about 5% to about 95% by weight of the non-ionomeric acid copolymer or terpolymer, and from about 95% to about 5% by weight of the stiffening polymer. The non-ionomeric composition has a flexural modulus of preferably at least about 30,000 psi, more preferably from about 40,000 psi to about 150,000 psi, and most preferably from about 60,000 psi to about 100,000 psi. The non-ionomeric composition also has a material hardness of preferably at least about 55 Shore D, more preferably from about 60 Shore D to about 90 Shore D, and most preferably from about 60 Shore D to about 75 Shore D.

Suitable non-ionomeric stiffening polymers for the present invention include, without limitation, the following homopolymeric or copolymeric polymers and blends thereof, as well as their derivatives that are compatibilized with at least one grafted or copolymerized function group, such as maleic anhydride, amine, epoxy, isocyanate, hydroxyl, sulfonate, phosphonate, and the like. The non-ionomeric compositions of the present invention may incorporate any one of these stiffening polymers, or a combination of two or more stiffening polymers. Specific stiffening polymers are:

1) Polyamides such as any of those disclosed in U.S. Pat. Nos. 6,187,864; 6,001,930; and 5,981,654, all of which are incorporated herein by reference in their entirety;
2) Single-site catalyzed polymers such as metallocene-catalyzed polymers having a flexural modulus comparable to that of polypropylenes (130–220,000 psi), and particularly those having a grafted or copolymerized function group to improve compatibility, such as maleic anhydride, amine, epoxy, isocyanate, hydroxyl, etc., and any of those disclosed in U.S. Pat. Nos. 6,274,669; 5,919,862; 5,981,654; and 5,703,166, all of which are incorporated herein by reference in their entirety;

3) Polyesters, particularly those modified with a compatibilizing group such as sulfonate or phosphonate, including modified poly(ethylene terephthalate), modified poly(butylene terephthalate), modified poly (propylene terephthalate), modified poly(trimethylene terephthalate), modified poly(ethylene naphthenate), and blends thereof, also those disclosed in U.S. Pat. Nos. 6,353,050; 6,274,298; and 6,001,930, all incorporated by reference in their entirety;
4) Polystyrene polymers such as poly(styrene-co-maleic anhydride), acrylonitrile-butadiene-styrene ("ABS"), poly(styrene sulfonate), polyethylene styrene, and blends thereof;
5) Grafted polypropylenes and grafted polyethylenes that are modified with a functional group such as maleic anhydride or sulfonate to improve compatibility;
6) Polyvinyl chlorides and grafted polyvinyl chlorides;
7) Very low-grade polyvinyl acetates, preferably having less than about 9% of vinyl acetate by weight, more preferably less than 5% by weight;
8) Polycarbonates, blends of polycarbonate/ABS, and blends of polycarbonate/polyurethane;
9) Polyvinyl alcohols and copolymers thereof;
10) Polyethers such as polyarylene ethers, polyphenylene oxides; block copolymers of alkenyl aromatics with vinyl aromatics and poly(amic ester)s, and the like;
11) Polyimides, polyetherketones, polyamideimides, and the like.

The non-ionomeric compositions of the intermediate layer may further incorporate other additives well known to one skilled in the art. Such additives include, but are not limited to, fillers, fibers, flakes, particles, density or specific gravity modifying agents, plasticizers, flow modifiers, adhesion modifiers, foaming agents, processing aids, processing oils, etc. In one embodiment, the non-ionomeric composition includes at least one modulus-enhancing filler, hardness-enhancing filler, or stiffness-enhancing filler. Such fillers include, for example, metal (or metal alloy) powder, metal oxide and salts, particulate, carbonaceous materials, and the like or blends thereof. Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulate carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled cured center material mixed and ground to 30 mesh particle size), manganese powder, and magnesium powder. Preferred fillers include tungsten, tungsten oxide, tungsten metal powder, barium sulfate, carbon black, silica, titanium oxide, or a mixture thereof in the forms of nano-scale or micro-scale fibers, filaments, flakes, whiskers, wires, tubes, or particulate.

Other materials that are useful in the non-ionomeric compositions of the present invention include those disclosed in U.S. Pat. Nos. 6,353,058; 6,245,862; 5,919,100; and in U.S. patent application Ser. Nos. 10/082,577 and 09/815,753, as well as water vapor barrier materials disclosed in U.S. patent application Ser. No. 09/973,342, all of which are incorporated herein by reference in their entirety. The suitable stiffening polymers discussed above are all non-ionomeric compounds, which are compounds that are free of ions.

While the compositions disclosed herein are preferred for intermediate layers such as outer core layers and inner cover layers, they are certainly also useful in other parts of the golf ball, such as the core center, the inner core layers, and the outer cover layer. The intermediate layer preferably has a thickness of from about 0.005 inches to about 0.1 inches, more preferably from about 0.01 inches to about 0.05 inches, and most preferably from about 0.015 inches to about 0.03 inches. Alternatively, the thickness of the intermediate layer can be greater than 0.1 inches. The intermediate layer preferably has an outer diameter of from about 1.5 inches to about 1.65 inches, more preferably from about 1.55 inches to about 1.63 inches, and most preferably about 1.62 inches. The intermediate layers of the present invention can also be used in golf balls having solid, liquid-filled, gel-filled, or gas-filled core centers, and in golf balls having one or more wound layers as outer core layers. Furthermore, the compositions of the present invention can used in any number of intermediate layers, outer core layers, and inner cover layers of a multi-layer golf ball.

In an alternative embodiment of the invention, the non-ionomeric composition of the intermediate layer may include a blend of at least two non-ionomeric acid copolymers and/or terpolymers and a non-ionomenic stiffening polymer, all of which are described above. The non-ionomeric composition has a flexural modulus and a material hardness substantially greater than the blend of non-ionomeric acid copolymers and terpolymers. The non-ionomeric acid copolymer blend is present in an amount of from about 5% to about 95% by weight of the non-ionomeric composition. Preferably, the weight ratio between any two non-ionomeric acid polymers in the blend is between about 5:95 and about 95:5. Examples include blends of a non-ionomeric acid terpolymer such as EMAAA and a non-ionomeric acid copolymer such as EAA or EMAA, or blends of two non-ionomeric acid copolymers such as EAA and EMAA. The non-ionomeric composition having the blend of non-ionomeric acid polymers preferably has a flexural modulus of from about 40,000 psi to about 150,000 psi, a material hardness of from about 60 Shore D to about 90 Shore D, a MFR of at least about 1 g/10-min, and a WVTR less than the cover.

In accordance to another aspect of the invention, the intermediate layer may be made by a number of methods. A preferred method is a combination of injection molding half-shells, and then compression molding the half-shells around a core (solid or wound) to form the intermediate layer. Other combinatory molding methods include injection and compression molding as described in U.S. Pat. No. 6,319,451, reaction injection molding and compression molding as described in U.S. application Ser. No. 10/278,525, the entire disclosures of which are incorporated herein by reference. Another suitable method is referred to as the semi-cured shell preform method, where a quantity of mixed stock of the preferred material composition is placed into a compression mold and molded under sufficient pressure, temperature and time to produce semi-cured, semi-rigid half-shells. The half-shells are then place around a core and the sub-assembly is cured in another compression molding machine to complete the curing process and to reach the desirable size. Detailed disclosures of this method are found in U.S. Pat. Nos. 6,180,040 and 6,093,357, and are incorporated herein by reference in their entirety.

Other suitable manufacturing techniques include sheet stock and vacuum shrink-wrap, injection molding, spraying, dipping, casting, vacuum deposition, reaction injection molding, among others. A two-pack casting method, such as the one disclosed in U.S. Pat. No. 5,897,884, may also be used. A simplified casting method using a single block material to produce the intermediate layer can also be used. More particularly, this simplified method is usable to make any castable components of the golf ball, including any intermediate layer, the innermost core or any portion of the cover. The suitable manufacturing methods discussed herein are discussed in more details in co-pending U.S. patent application Ser. No. 09/973,342, which is incorporated by reference in its entirety.

The cover of the golf ball provides the interface between the ball and a club and other objects such as trees, cart paths, and grass. Properties that are desirable for the cover include high abrasion resistance, high tear strength, and high resilience. The cover generally provides sufficient strength for good performance characteristics and durability. The cover may comprise one or more layers, including inner cover layers and outer cover layer. In one embodiment, the cover comprises two or more inner cover layers. The cover can be comprised of the following homopolymeric and copolymeric materials used solely or in conjunction with one another, including:

(1) Non-ionomeric acid polymers such as copolymers of an olefin and a carboxylic acid or terpolymers of an olefin and a softening comonomer and a carboxylic acid, in which the olefin has from 2 to 8 carbon atoms and the carboxylic acid has 3 to 8 carbon atoms. The carboxylic acid groups may include acrylic, methacrylic, crotonic, maleic, fumaric or itaconic acid. The softening comonomer includes vinyl esters of aliphatic carboxylic acids wherein the acid has 2 to 10 carbon atoms, alkyl ethers wherein the alkyl group has 1 to 10 carbon atoms, alkyl acrylates wherein the alkyl group has 1 to 10 carbon atoms, or alkyl alkylacrylates wherein the alkyl group has 1 to 10 carbon atoms. Preferred non-ionomeric acid polymers include Nucrel® from E.I. DuPont de Nemours & Company and Escor® from ExxonMobil. These are copolymers or terpolymers of ethylene and methacrylic acid or acrylic acid partially neutralized. Preferably these ionomers comprises at least about 10% by weight of the carboxylic acid, more preferably at least about 16% by weight.

(2) Ionomers such as ionic versions of the copolymers or terpolymers described in (1) above. Specifically, the carboxylic acid groups are totally or partially neutralized with cations. Preferred ionomers include Surlyn® from E.I. DuPont de Nemours & Company and Totek® from ExxonMobil. These are copolymers or terpolymers of ethylene and methacrylic acid or acrylic acid partially neutralized with zinc, sodium, lithium, magnesium, potassium, calcium, manganese, nickel or the like.

(3) Polyolefins such as polyethylene, polypropylene, polybutylene and copolymers such as ethylene methylacrylate, ethylene ethylacrylate, ethylene vinyl acetate, copolymers and homopolymers produced using single-site catalyst such as metallocene.

(4) Polyurethanes such as those prepared from polyols and diisocyanates or polyisocyanates, including thermoplastic polyurethanes, thermoset polyurethanes, and polyurethane ionomers.

(5) Polyurea such as thermoplastic polyurea, thermoset polyurea, polyurea ionomers, and include those disclosed in U.S. Pat. No. 5,484,870, U.S. patent application Ser. Nos. 10/072,395 and 10/228,311, all of which are incorporated herein by reference in their entirety.

(6) Vinyl resins such as those formed by the polymerization of vinyl chloride, or by the copolymerization of vinyl chloride with vinyl acetate, acrylic esters or vinylidene chloride.

(7) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(8) Acrylic resins and blends of these resins with poly vinyl chloride, elastomers, etc.

(9) Vulcanized synthetic or natural rubbers such as balata.

(10) Thermoplastics such as the urethanes, olefinic thermoplastic rubbers such as blends of polyolefins with ethylene-propylene-non-conjugated diene terpolymer, block copolymers of styrene and butadiene, thermoplastic block copolymers such as Kraton® rubbers from Shell Chemical, isoprene or ethylene-butylene rubber, or co-poly(ether amide), such as Pebax® from AtoFina.

(11) Polyphenylene oxide resins, or blends of polyphenylene oxide with high impact polystyrene such as Noryl® from General Electric Company.

(12) Thermoplastic polyesters, such as polyethylene terephthalate.polybutylene terephthalate, polyethylene terephthalate/glycol modified and elastomers, including Hytrel® from E.I. DuPont de Nemours & Company and Lomod® from General Electric Company.

(13) Blends and alloys, including polycarbonate with acrylonitrile-butadiene-styrene, polybutylene terephthalate, polyethylene terephthalate, styrene maleic anhydride, polyethylene, elastomers, polyvinyl chloride with acrylonitrile butadiene styrene or ethylene vinyl acetate or other elastomers, blends of thermoplastic rubbers with polyethylene, propylene, polyacetal, nylon, polyesters, cellulose esters, etc.

Any of the cover layers may be formed from polymers containing $\alpha,\beta$-unsaturated carboxylic acid groups, or the salts thereof, that have been highly neutralized with cations. The acid moieties of the highly-neutralized ionomers, typically ethylene-based ionomers, are preferably neutralized by at least about 70%, more preferably by greater than about 90%, and most preferably by about 100%. The highly-neutralized ionomers can be also be blended with a second polymer component, which, if containing an acid group, may also be neutralized. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like.

Polyurethane-type materials may form cover layers or any other layers in the golf balls of the present invention, preferably outer cover layers. Suitable polyurethanes include, but are not limited to, thermoset polyurethanes, thermoplastic polyurethanes, polyurethane ionomers, polyurethane-urea, polyurea-urethnaes, or polyurethane-epoxies, that comprise the reaction product of at least one polyisocyanate, polyol, and at least one curing agent.

Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("HMDI"); p-phenylene diisocyanate ("PPDI"); m-phenylene diisocyanate ("MPDI"); toluene diisocyanate ("TDI"); 3,3'-dimethyl-4,4'-biphenylene diisocyanate ("TODI"); isophorone diisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4- diisocyanate; 1-isocyanato-3,3,5- trimethyl-5- isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; napthalene diisocyanate; anthracene diisocyanate; isocyanurate of toluene diisocyanate; uretdione of hexamethylene diisocyanate; and mixtures thereof. Preferably, the polyisocyanate includes MDI, PPDI, TDI, or a mixture thereof. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer HDI, Low Free Monomer TDI, and Low Free Monomer PPDI. The polyisocyanate should have less than about 14% unreacted NCO groups. Preferably, the at least one polyisocyanate has no greater than about 7.5% NCO, and more preferably, less than about 7.0%. It is well understood in the art that the hardness of polyurethane can be correlated to the percent of unreacted NCO groups.

Any polyol available to one of ordinary skill in the art is suitable for use according to the invention. Exemplary polyols include, but are not limited to, polyether polyols, hydroxyl-terminated polybutadiene (including partially or fully hydrogenated derivatives), polyester polyols, polycaprolactone polyols, and polycarbonate polyols. In one preferred embodiment, the polyol includes a polyether polyol, such as polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, PTMEG-initiated polycaprolactone, and mixtures thereof. The hydrocarbon chain can have saturated or unsaturated bonds, or substituted or unsubstituted aromatic and cyclic groups. Suitable polycarbonates include, but are not limited to, polyphthalate carbonate and poly (hexamethylene carbonate) glycol. The hydrocarbon chain can have saturated or unsaturated bonds, or substituted or unsubstituted aromatic and cyclic groups.

Curing agents for polyurethanes of the present invention include hydroxyl-terminated curatives and amine curatives. Suitable hydroxyl-terminated curatives may be diols, triols or tetraols, and include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxyl-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof.

Amine curatives, including both primary and secondary amines, are also suitable for use in polyurethane covers or layers. Particular amine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferred polyamine curatives include 3,5-dimethylthio-2,4-toluenediamine and isomers thereof, such as Ethacure® 300 from Albermarle Corporation.

Both the hydroxyl-terminated and amine curatives can include one or more saturated, unsaturated, aromatic, and/or cyclic groups. Additionally, the hydroxyl-terminated and amine curatives can include one or more halogen groups. The polyurethane composition can be formed with a blend or mixture of curing agents. If desired, however, the polyurethane composition may be formed with a single curing agent.

One method well known to the skilled artisan for making polyurethanes is the prepolymer method, wherein a polyurethane prepolymer is produced by reacting at least one polyol with at least one isocyanate. The prepolymer can then be cured with a diol curative or a secondary amine curative to form a thermoplastic polyurethane, or cured with a triol or tetraol curative to form a thermoset polyurethane. The choice of the curatives is critical because some prepolymers cured with diols do not produce urethane elastomers with the impact resistance suitable for a golf ball cover. Blending amine curatives in diol-cured polyurethane compositions may result in thermoset polyurethanes with improved impact and cut resistance. Other suitable thermoplastic polyurethane resins include those disclosed in U.S. Pat. No. 6,235,830, which is incorporated herein by reference in its entirety.

In a preferred embodiment of the present invention, saturated (aliphatic and alicyclic) polyurethanes formed from saturated polyisocyanates, saturated polyols and saturated curatives are used to form cover layers, preferably the outer cover layer. As used herein, the term "saturated" refers to a compound or material that is substantially free of aromatic groups or moieties. Saturated polyisocyanates include, but are not limited to, ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; IPDI; methyl cyclohexylene diisocyanate; triisocyanate of HDI; TMDI. The most preferred saturated diisocyanates are 4,4'-dicyclohexylmethane diisocyanate and IPDI.

Saturated polyols include, but are not limited to, polyether polyols such as polytetramethylene ether glycol and poly (oxypropylene) glycol. Suitable saturated polyester polyols include polyethylene adipate glycol, polyethylene propylene adipate glycol, polybutylene adipate glycol, polycarbonate polyol, and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, PTMEG-initiated polycaprolactone. The most preferred saturated polyols are PTMEG and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino propylamine, imido-bis-propylamine, isomers and mixtures of isomers of diaminocyclohexane, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Preferably, the saturated polyurethane comprises by weight from about 1 to about 100%, more preferably from about 10 to about 75% of the cover or layer composition. The thermoset polyurethanes may be castable, reaction injection moldable, sprayable, or applied in a laminate form or by any technical known in the art. The thermoplastic polyurethanes may be processed using any number of compression or injection techniques.

Conventional additives for golf ball cores, covers, and layers may be blended with any compositions disclosed herein for any portion of the golf ball. Such additives include catalysts; surfactants; blowing agents for foams; stabilizers; metals; antioxidants; colorants including pigments and dyes; optical brighteners; density- or modulus-adjusting fillers; viscosity modifiers; release agents; plasticizers; processing aids and oils; compatibility agents; dispersing agents; UV absorbers, hindered amine light stabilizers, etc. Pigments may be fluorescent, autofluorescent, luminescent, or chemoluminescent, and include white pigments such as titanium oxide and zinc oxide. Suitable catalysts for polyurethane-based covers or layers include, but are not limited to bismuth catalyst, oleic acid, triethylenediamine (Dabco®-33LV), di-butyltin dilaurate (Dabco®-T12) and acetic acid. The most preferred catalyst is di-butyltin dilaurate (Dabco®-T12). Dabco® materials are available from Air Products and Chemicals, Inc. Suitable UV absorbers and light stabilizers include Tinuvin® 213, 328, 622, 765 and 770. Tinuvin® products are available from Ciba-Geigy. These additives may be present in any amounts that will achieve their desired purposes.

Any method known to one of ordinary skill in the art may be used to produce the polyurethane-based covers of the present invention. One-shot method involving concurrent mixing of the polyisocyanate, polyol, and curing agent is feasible, but the resulting mixture is non-homogeneous and difficult to control. A preferred method of mixing is known as a prepolymer method. In this method, the polyisocyanate and the polyol are mixed separately prior to addition of the curing agent. This method affords a more homogeneous mixture resulting in a more consistent polymer composition. Other methods suitable for forming the layers of the present invention include reaction injection molding ("RIM"), liquid injection molding ("LIM"), injection and compression molding, pre-reacting the components to form an injection moldable thermoplastic polyurethane and then injection molding, and combinations thereof. Castable and reactive materials such as urethane elastomers, when applied in a fluid form, can provide very thin layers such as outer cover layers that are desirable on golf balls. Specific application techniques include spraying, dipping, spin coating, or flow coating methods.

The outer cover layer of the above-disclosed compositions preferably has a flexural modulus, as measure on the golf ball in accordance to ASTM 6272-02, of from about 500 psi to about 15,000 psi. The outer cover layer is preferably thin with a thickness of less than about 0.05 inches, and more preferably about 0.03 inches or less. Alternatively, the cover thickness is between about 0.05 inches and about 0.2 inches, more specifically from about 0.05 to about 0.09 inches. The outer cover layer may have any on-ball hardness; preferably the on-ball hardness of the outer cover layer is less than about 60 Shore D. The composition of the outer cover layer preferably has a material hardness of less than about 70 Shore D. The resulting golf ball, including the core, the intermediate layer and the cover as described above, preferably has a COR of greater than about 0.8, and more preferably greater than about 0.81. The golf ball preferably has an Atti compression of at least about 30, more preferably from about 50 to about 120, and most preferably from about 55 to about 85. The golf ball preferably has an overall diameter of at least about 1.68 inches, which is the minimum size set forth by the United States Golf Association. In one embodiment, the overall diameter of the golf ball is from about 1.68 inches to about 1.76 inches. The golf ball further has a dimple coverage on its outermost surface of greater than about 60%, preferably greater than about 80%.

The compositions for the intermediate layer of golf balls as disclosed herein may be used in sporting equipment in general. Specifically, the compositions may be applied in various game balls, golf club shafts, golf club head inserts, golf shoe components, and the like.

All patents and patent applications cited in the foregoing text are expressly incorporated herein by reference in their entirety.

The invention described and claimed herein is not to be limited in scope by the specific embodiments herein disclosed, since these embodiments are intended solely as illustrations of several aspects of the invention. Any equivalent embodiments and various modifications apparent to those skilled in the art are intended to be within the scope of this invention. It is further understood that the various features of the present invention can be used singly or in combination thereof. Such modifications and combinations are also intended to fall within the scope of the appended claims.

What is claimed is:

1. A golf ball comprising a core, a cover, and a intermediate layer therebetween consisting essentially of a non-ionomeric composition comprising (a) a blend of a first and second acid copolymers, each having a formula of E/Y or E/X/Y, where E is an olefin, Y is a carboxylic acid and X is a softening comonomer, and (b) a non-ionomeric stiffening polymer, wherein the acid polymer blend has a first flexural modulus and a first material hardness; and wherein the non-ionomeric composition has a second flexural modulus and a second material hardness substantially greater than the first flexural modulus and the first material hardness.

2. The golf ball of claim 1, wherein the first and second non-ionomeric acid polymers have a weight ratio of from about 5:95 to about 95:5.

3. The golf ball of claim 1, wherein the second flexural modulus ranges from about 40,000 psi to about 150,000 psi, and the second material hardness ranges from about 55 Shore D to about 90 Shore D.

4. The golf ball of claim 1, wherein the first non-ionomeric acid polymer comprises ethylene/acrylic acid copolymers or ethylene/methacrylic acid copolymers, and the non-ionomeric second acid polymer comprises ethylene/methyl acrylate/acrylic acid terpolymers, ethylene/n-butyl acrylate/methacrylic acid terpolymers, or ethylene/isobutyl acrylate/methacrylic acid terpolymers.

5. The golf ball of claim 1, wherein the non-ionomeric acid polymer blend is present in an amount ranging from about 5% to about 95% by weight of the non-ionomenrc composition.

6. The golf ball of claim 1, wherein the non-ionomeric composition has a melt flow rate of at least about 1 g/10-min, and a first water vapor transmission rate less than a second water vapor transmission rate of the cover.

7. The golf ball of claim 1, wherein the intermediate layer has a thickness ranging from about 0.01 inches to about 0.05 inches.

8. The golf ball of claim 1, wherein the non-ionomeric composition further comprises at least one modulus-enhancing filler, hardness-enhancing filler, or stiffness-enhancing filler.

9. The golf ball of claim 1, wherein the second flexural modulus is about 60,000 psi to about 100,000 psi, and the second material hardness is about 60 Shore D to about 75 Shore D.

10. The golf ball of claim 1, wherein the intermediate layer has a thickness of about 0.03 inches or less.

11. The golf ball of claim 1, wherein the core has a diameter of at least about 1.5 inches to about 1.65 inches, a compression of less than about 70, and a coefficient of restitution of at least about 0.75.

12. The golf ball of claim 1, wherein the core comprises two or more outer core layers, and/or the cover comprises two or more inner cover layers.

13. The golf ball of claim 1, wherein the first non-ionomeric acid polymer comprises ethylene/acrylic acid copolymers, and the second non-ionomeric acid polymer comprises ethylene/methacrylic acid copolymers.

14. The golf ball of claim 1, wherein the non-ionomeric composition further comprises at least a second stiffening polymer.

15. A golf ball comprising a core, a cover, and at least one non-ionomeric intermediate layer therebetween, the intermediate layer comprising:

at least one acid copolymer or terpolymer having a formula of E/Y or E/X/Y, where E is an olelin, Y is a carboxylic acid and X is a softening comonomer chosen from alkyl ethers of 1 to about 10 carbon atoms, alkyl acrylares and alkyl alkylacrylates of 1 to about 10 carbon atoms; and at least one stiffening polymer or blend of two or more stiffening polymers chosen from single-site catalyzed polymers, metallocene-catalyzed polymers, poly (ethylene naphthenate), polystyrene polymers, poly (styrene-co-maleic anhydride), acrylonitrile-butadiene-styrene, poly(styrene sulfonate), polyethylene styrene, grafted polypropylenes, grafted polyelhylenes, polyvinyl chlorides; grafted polyvinyl chlorides; polyvinyl acetates having less than about 9% of vinyl acetate by weight, polycarbonates, blends of polycarbonate and acrylonitrile-butadiene-styrene, blends of polycarbonate and polyurethane, polyvinyl alcohol copolymers, polyethers, polyarylene ethers, polyphenylene oxides; block copolymers of alkenyl aromatics with vinyl aromatics and poly(amic ester)s, polyimides, polyetherketones, and polyamideimides.

16. The golf ball of claim 15, wherein the olefin comprises ethylene; the carboxylic acid comprises acrylic acid, methacrylic acid, crotonic acid, maleic acid, fumaric acid, or itaconic acid; and the softening comonomer comprises vinyl esters of aliphatic carboxylic acids of 2 to about 10 carbon atoms, alkyl ethers of 1 to about 10 carbon atoms, alkyl acrylates or alkyl alkylacrylates of 1 to about 10 carbon atoms.

17. The golf ball of claim 16, wherein the non-ionomeric copolymer comprises ethylene/acrylic acid copolymers or ethylene/methacrylic acid copolymers, and the non-ionomenrc terpolymer comprises ethylene/methyl acrylate/acrylic acid terpolymers, ethylene/n-butyl acrylate/methacrylic acid terpolymers, or ethylene/isobutyl acrylate/methacrylic acid terpolymers.

18. The golf ball of claim 15, wherein the acid copolymer or terpolymer has a flexural modulus of about 5,000 psi to about 55,000 psi, and a material hardness of about 20 Shore D to about 65 Shore D.

19. The golf ball of claim 15, wherein the copolymer or terpolymer is present in an amount ranging from about 5% to about 95% by weight of the composition.

20. The golf ball of claim 15, wherein the stiffening polymer is compatibilized with at least one grafted or copolymerized functional group comprising maleic anhydride, amine, epoxy, isocyanate, hydroxyl, carbonate, sulfonate, or phosphonate.

21. The golf ball of claim 15, wherein the stiffening polymer is present in an amount ranging from about 95% to about 5% by weight of the non-ionomeric composition.

22. The golf ball of claim 15, wherein the intermediate layer has a thickness of from about 0.005 inches to about 0.1 inches.

23. The golf ball of claim 15, wherein the core has a diameter of at least about 1.3 inches, a compression of less than about 80, and a coefficient of restitution of at least about 0.75.

24. The golf ball of claim 15, wherein the core is formed from a center and at least one outer core layer;

the center is solid, liquid-filled, gel-filled, or gas-filled; and the at least one outer core layer comprises a solid continuous layer, a discontinuous layer, a wound layer, an adhesive layer, or a lattice network layer.

25. The golf ball of claim 15, wherein the cover comprises an outer cover layer and optionally one or more inner cover layers; and wherein the outer cover layer has a thickness of less than about 0.05 inches and an material hardness of less than about 70 Shore D.

26. The golf ball of claim 15, wherein the non-ionomeric composition further comprises at least one modulus-enhancing filler, hardness-enhancing filler, or stiffness-enhancing filler.

27. The golf ball of claim 15, wherein the intermediate layer has a thickness of about 0.03 inches or less.

28. The golf ball of claim 15, wherein the core has a diameter of at least about 1.5 inches to about 1.65 inches, a compression of less than about 70, and a coefficient of restitution of at least about 0.75.

29. The golf ball of claim 15, wherein the core comprises two or more outer core layers, and/or the cover comprises two or more inner cover layers.

* * * * *